US005547447A

United States Patent [19]

Liang

[11] Patent Number: 5,547,447

[45] Date of Patent: Aug. 20, 1996

[54] EXERCISING APPARATUS FOR TWISTING EXERCISES

[76] Inventor: Fa-Kuang Liang, B1, No. 20, Shian-Man St., Taipei, Taiwan

[21] Appl. No.: 402,281

[22] Filed: Mar. 10, 1995

[51] Int. Cl.[6] ..... A63B 21/16

[52] U.S. Cl. ..... 482/146; 482/147; 482/34

[58] Field of Search ..... 280/87.042, 87.041; 482/146, 147, 148, 34

[56] References Cited

U.S. PATENT DOCUMENTS

| | | | |
|---|---|---|---|
| 3,108,802 | 10/1963 | Sunquist | 482/146 |
| 4,095,817 | 6/1978 | Cohen | 280/87.042 |
| 4,149,735 | 4/1979 | Blackburn et al. | 280/87.042 |
| 4,285,516 | 8/1981 | Heatwole | 482/146 |
| 4,530,498 | 7/1985 | Heatwole | 482/146 |
| 5,292,296 | 3/1994 | Davignon | 482/146 |
| 5,320,593 | 6/1994 | Heatwole | 482/146 |

*Primary Examiner*—Jerome Donnelly
*Attorney, Agent, or Firm*—Pro-Techtor International

[57] ABSTRACT

An exercising apparatus including an elongated base supported on two stands and having two foot plates with bottom pulleys at two opposite ends. Each stand consists of a top section fixed to the base, a flat bottom section rotatable about a bolt affixed to the top section, and a plurality of bearings supported between the top section and the bottom section. The apparatus moves when the user twists his body thereon.

1 Claim, 6 Drawing Sheets

EXERCISING APPARATUS FOR TWISTING EXERCISES

BACKGROUND OF THE INVENTION

The present invention relates to exercising devices, and more particularly is an exercising apparatus which moves when the operator twists his body thereon.

A variety of exercising devices including rowing machines, stationary bicycles, steppers, slim machines, etc. have been developed for exercising different parts of the body. These exercising machines do not move from place to place when operated. Although they are functional, they cannot be used as a device for playing a game while producing an exercising effect.

SUMMARY OF THE INVENTION

The present invention has been accomplished to provide an exercising apparatus which can be used as a gymnastic apparatus for physical exercises as well as a device for playing games.

According to the preferred embodiment of the present invention, the exercising apparatus comprises an elongated base supported on two stands and having two foot plates with bottom wheels at two opposite ends. Each stand is comprises of a top section fixed to the base, a fiat bottom section rotatable about a bolt affixed to the top sections, and a plurality of ball bearings supported between the top section and the bottom section. Therefore, the apparatus moves when the user steps on the foot plates and twists his body.

DETAILED DESCRIPTION OF THE PREFERRED EMBODIMENT

Figure 1:
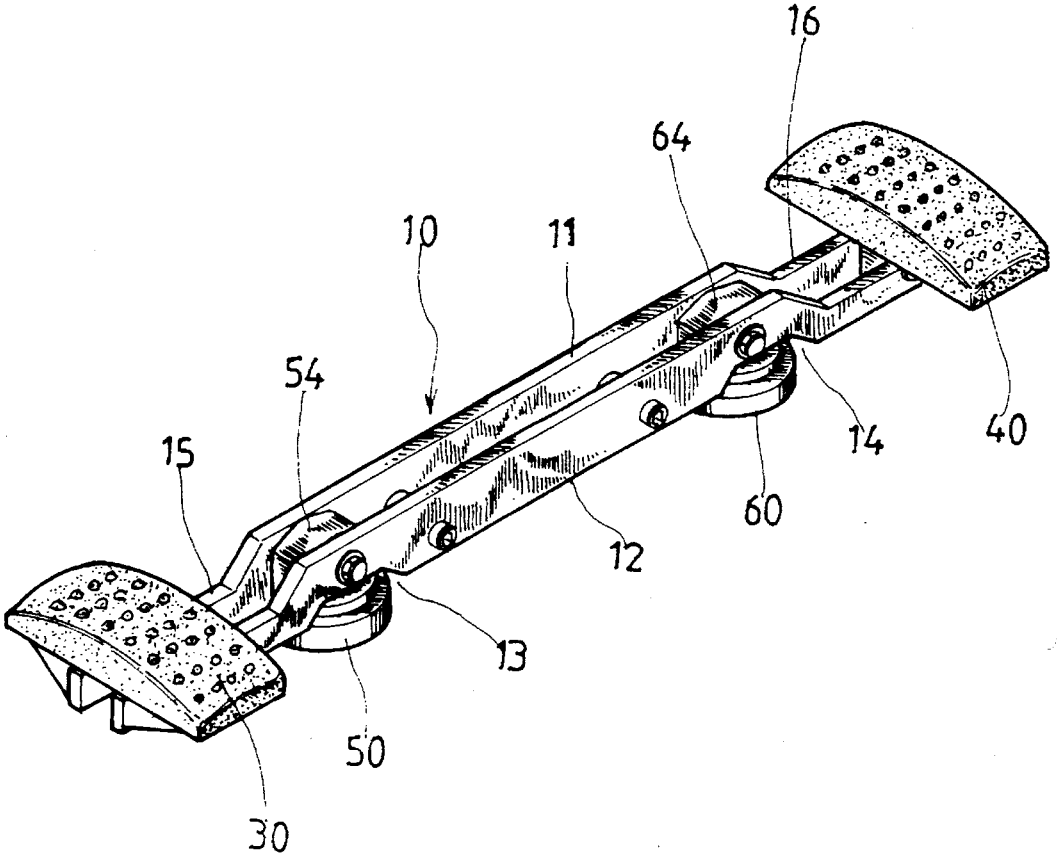
FIG. 1 is a prospective view of an exercising apparatus according to the preferred embodiment of the present invention.

Referring to FIG. 1, an exercising apparatus in accordance with the present invention is generally comprised of a base 10 of proper length (approximately equal to the combined length of the user's shoulders). The base 10 is formed by connecting two elongated, fiat frames 11 and 12 in parallel, and supported on two stands 50 and 60. Two foot plates 30 and 40 are fixed to the base 10 at two opposite ends.

Figure 2:
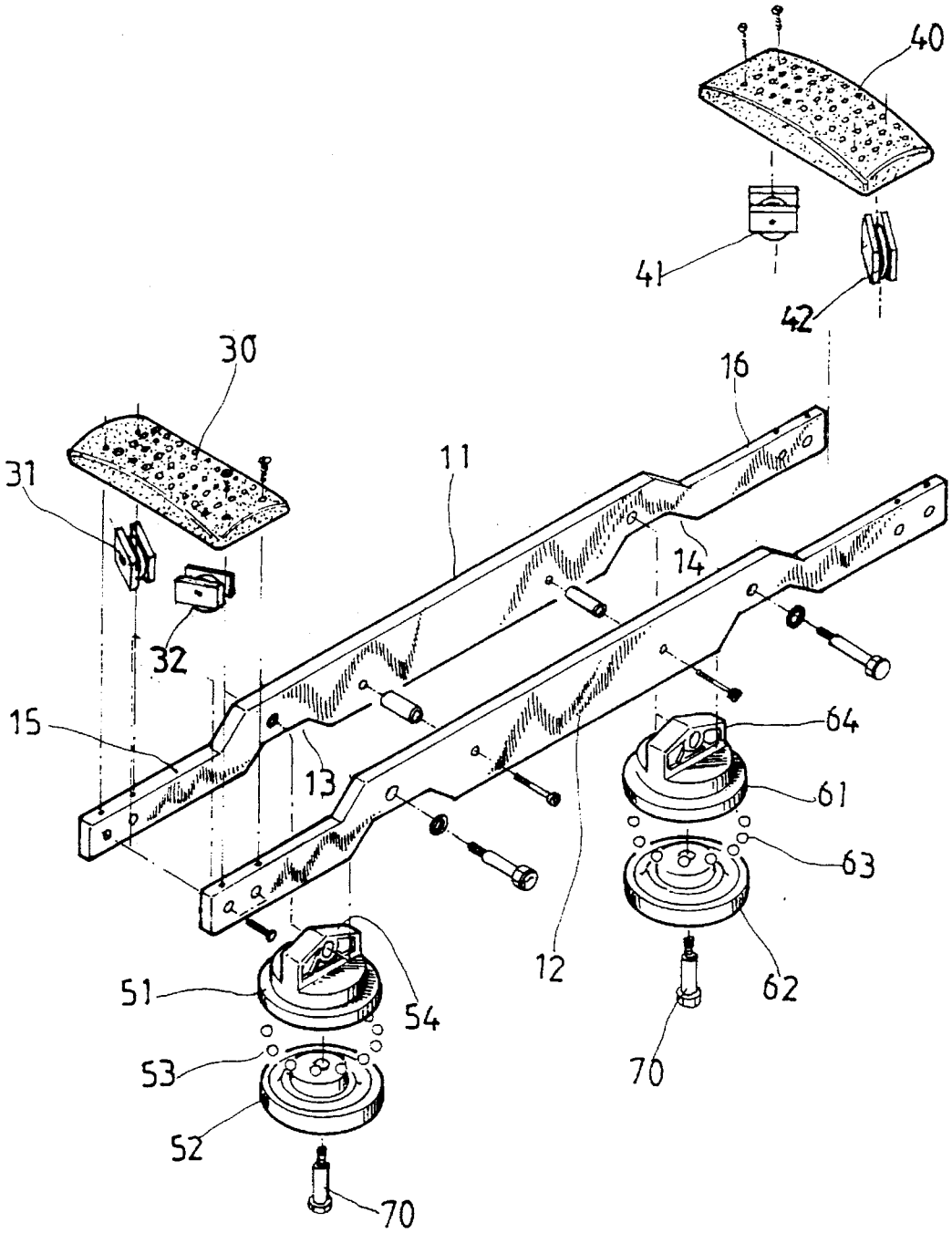
FIG. 2 is an exploded view of the exercising apparatus shown in FIG. 1.

Referring to FIG. 2 and FIG. 1 again, the frames 11 and 12 have respective bottom notches 13 and 14 at the bottom for mounting the stands 50 and 60, and respective recessed portions 15 and 16 at the top for mounting the foot plates 30 and 40. The foot plates 30 and 40 are equipped with a respective pair of wheels 31, 32, 41, 42 that are angled in opposite directions.

Figure 3:
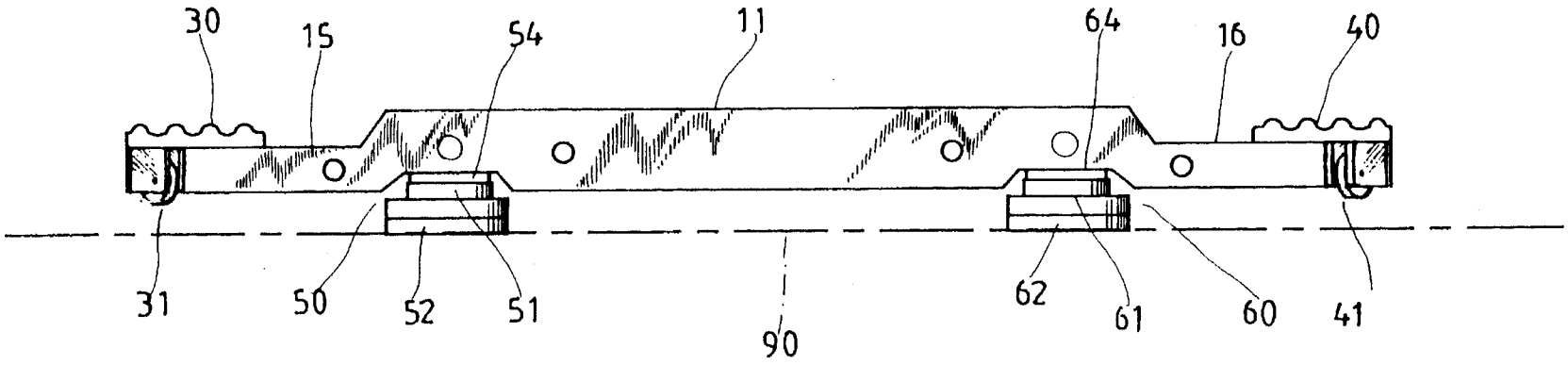
FIG. 3 is a side view of the exercising apparatus shown in FIG. 1 when placed on the ground.
Figure 4:
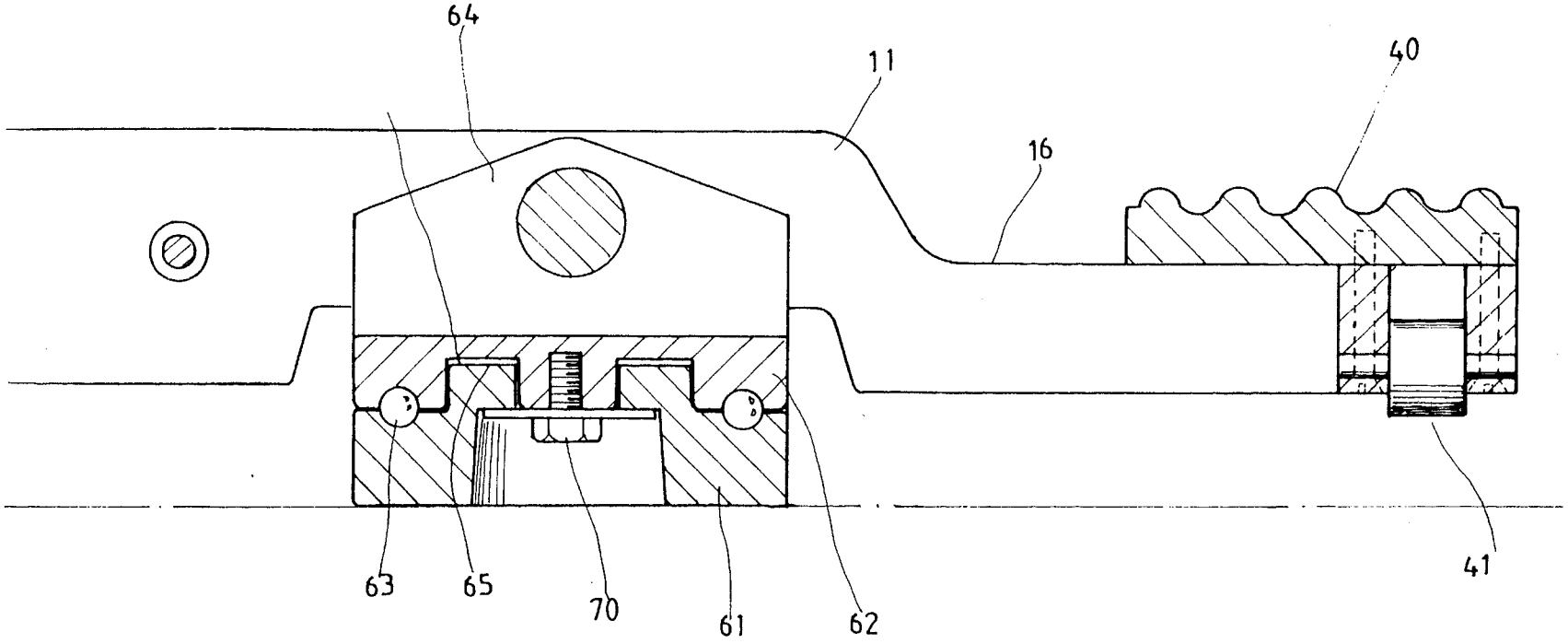
FIG. 4 is an enlarged cross section of an end of the apparatus.

Referring to FIGS. 3 and 4, stand 50 or 60 is comprised of a top section 51 or 61, a flat bottom section 52 or 62, and a plurality of ball bearings 53 or 63 between the top section 51 or 61 and the bottom section 52 or 62. The top section 51 or 61 has an upright top flange 54 or 64 pivotally coupled between the frames 11 and 12. The top section 51 or 61 further has a plurality of bottom grooves 55. The bottom section 52 or 62 further has a plurality of top tongues 65 respectively fitted into the bottom grooves 55 on the top section 51 or 61. When the top tongues 65 are respectively fitted into the bottom grooves 55, the top 51 or 151 and the bottom 52 or 82 are pivotally coupled by a bolt 70. When the exercising apparatus is assembled and placed on the ground, the base 10 is supported on the stands 50 and 60, and the wheels 31, 32, 41,42 of the foot plates 30 and 40 are suspended above the ground.

Figure 5:
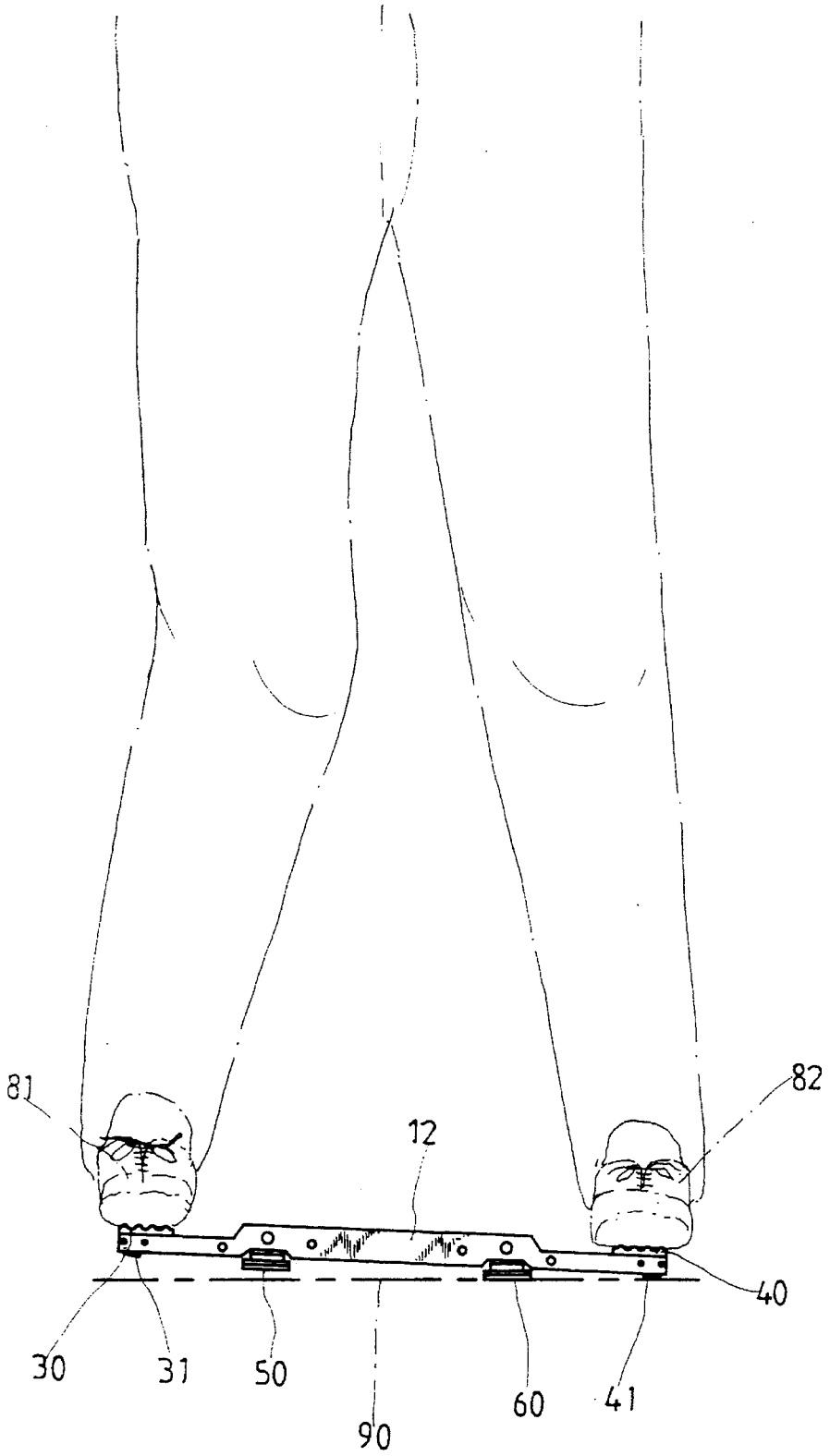
FIG. 5 shows an operator stepping on the exercising apparatus according to the present invention.

Referring to FIG. 5, when the exercising apparatus is supported on the ground 90 by the stands 50 and 60, the user's legs 81 and 82 can then step on the foot plates 30 and 40. When the user twists his body, the exercising apparatuses rotated back and forth. If the user exerts pressure to one foot plate 40 through the corresponding leg 82, the exercising apparatus is tilted sideways and supported in a tilted position by the wheel 41 and the stand 60, thereby allowing the user to move the other foot plate 30 forwards with his leg 81. On the contrary, If the user gives pressure to the foot plate 30 through the leg 81, the exercising apparatus is tilted sideways in the reverse direction and supported in a tilted position by the wheel 31 and the stand 50, thereby allowing the user to move the foot plate 40 forward with his leg 82.

Figure 6:
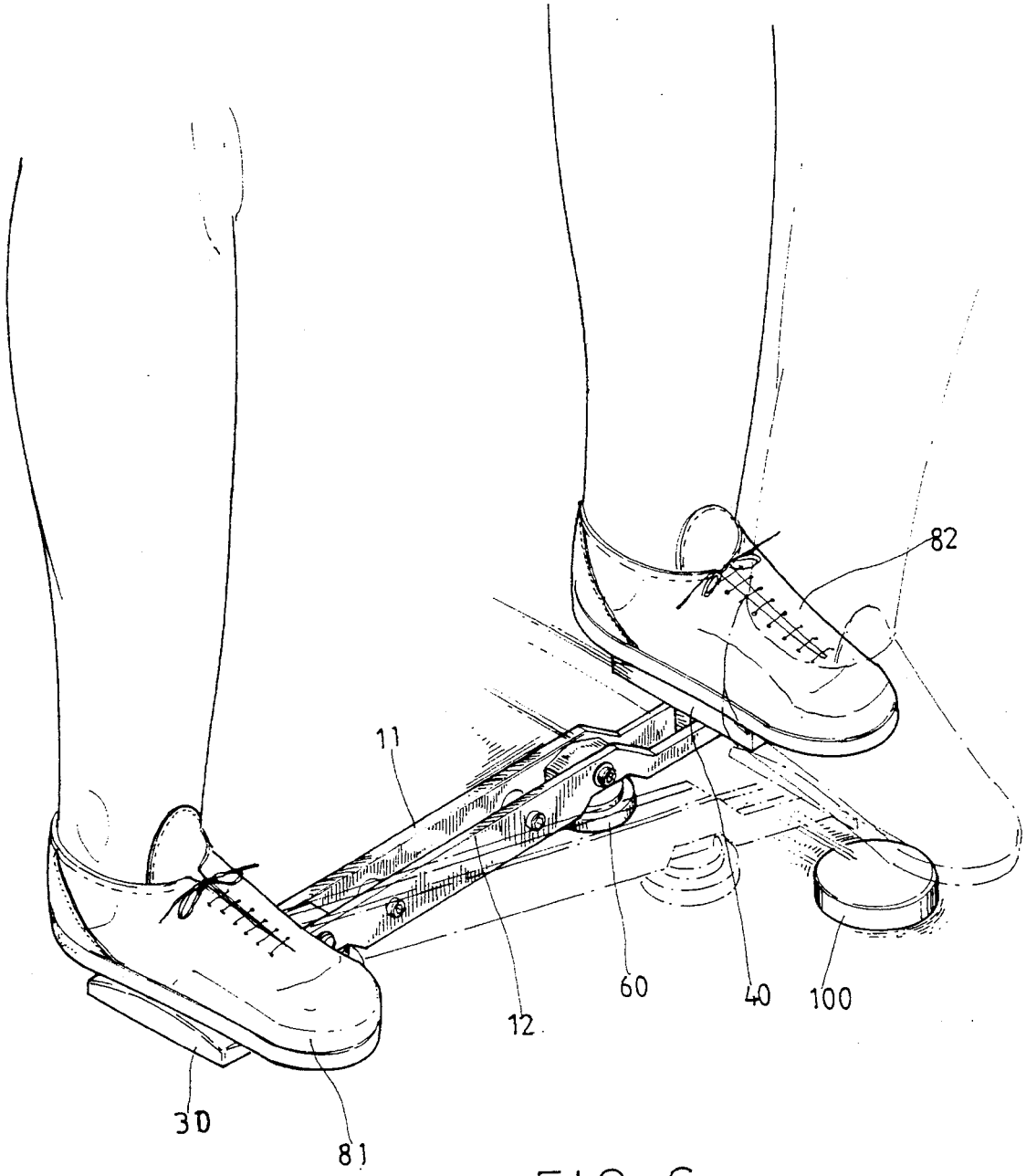
FIG. 6 shows how the operator's legs twist the exercising apparatus according to the present invention.

Referring to FIG. 6, a circular sliding block 100 may be placed on the ground so that the user can kick the circular sliding block 100 toward a goal when twisting the exercising apparatus.

It is to be understood that the drawings are designed for purposes of illustration only, and are not intended as a definition of the limits and scope of the invention disclosed.

What is claimed is:

1. An exercising apparatus for performing twisting exercises comprising:

an elongated base member including two foot plates, wherein each respective foot plate is fixedly mounted on a top side of said base member at opposite ends thereof, said base member further including two elongated frames, connected by said foot plates, in a parallel orientation, two stands, each stand including a top section having an upright flange member, a bottom section rotatably fastened to said top section and a plurality of ball bearings rotatably coupled between said top section and said bottom section, thereby allowing said bottom section to rotate relative to said top section, a bolt pivotally coupling each respective flange member of said stands to a bottom side to said base member intermediate said foot plates and between said elongated frames, thereby supporting said base on a supporting surface, and a plurality of wheels attached to an under surface of each of said foot plates, said wheels being suspended attached the supporting surface when said base is supported by both stands on the supporting surface.

* * * * *